US005581981A

United States Patent [19]

Fulkerson et al.

[11] Patent Number: 5,581,981

[45] Date of Patent: Dec. 10, 1996

[54] METHOD OF PACKAGING TOOTHBRUSHES

[75] Inventors: Gregory M. Fulkerson, Maple Plain; Michael R. Jennings, Bloomington; Stephen A. Kaye, Eden Prairie; Dwaine D. Raddatz, Hutchinson, all of Minn.

[73] Assignee: Thiele Engineering Company, Minneapolis, Minn.

[21] Appl. No.: 150,997

[22] Filed: Nov. 12, 1993

[51] Int. Cl.[6] ..... B65B 5/04; B65B 25/00; B65B 35/26; B65B 43/26

[52] U.S. Cl. ..... 53/458; 53/236; 53/252; 53/255; 53/258; 53/473; 53/566

[58] Field of Search ..... 53/473, 475, 236, 53/251, 250, 249, 252, 258, 458, 566, 255; 206/362.3, 361

[56] References Cited

U.S. PATENT DOCUMENTS

| | | | |
|---|---|---|---|
| 2,632,554 | 3/1953 | Wilcox | 53/236 X |
| 2,739,432 | 3/1956 | Hirschey | 53/236 |
| 3,456,425 | 7/1969 | Pezza | 53/236 |
| 3,516,214 | 6/1970 | Focke et al. | 53/236 X |
| 3,746,162 | 7/1973 | Bridges | 206/361 |
| 5,295,575 | 3/1994 | Gonzalez | 206/204 |

*Primary Examiner*—James F. Coan
*Attorney, Agent, or Firm*—Hugh D. Jaeger

[57] ABSTRACT

A device and method for packaging of toothbrushes in cartons where conveyored toothbrushes gravitationally descend in a containment slide to be released individually from a metering mechanism into dual slotted starwheels. Brushes from the starwheels are deposited into configured infeed buckets to be subsequently loaded into a carton by a brush inserter mechanism.

1 Claim, 22 Drawing Sheets

METHOD OF PACKAGING TOOTHBRUSHES

BACKGROUND OF THE INVENTION

1. Field of the Invention

The present invention pertains to a packaging device, and more particularly, relates to a device to handle and load toothbrushes or any other type of brush into a carton.

2. Description of the Prior Art

Typically toothbrushes are difficult objects to control mechanically due to their light weight and tendency to bounce and also roll due to their thin profile when placed or dropped into an infeed bucket in route to a cartoner.

The present invention precisely meters toothbrushes through a containment slide and pneumatic clamp arrangement into a starwheel assembly, which orients the toothbrush for precise placement within an infeed bucket designed to minimize rolling and to maximize a secure fit of the toothbrush into the infeed bucket.

SUMMARY OF THE INVENTION

The general purpose of the present invention includes a conveyor device which is fed by a precise positive control handling system where toothbrushes in vertical containment slides are released individually by a precise and controlled metering system into slots in successive starwheel assemblies. The toothbrushes are contained in the starwheel assemblies until precise alignment with an appropriately configured infeed bucket occurs. The toothbrushes are then deposited into each of the infeed buckets or into alternate infeed buckets, depending on the number of feed devices used. The infeed buckets are configured to have a shape similar to the edge of the toothbrush which readily accommodates the profile of the toothbrush without any danger of rolling about the axis of the toothbrush.

According to one embodiment of the present invention, there is provided a framework having a centrally located toothbrush conveyor having configured and shaped buckets to accommodate the profile of a toothbrush. One or more sets of conveyors provide a supply of toothbrushes to one or more containment slides where the brushes are stacked for subsequent metering by metering devices having clamping mechanisms and release mechanisms for release of a single toothbrush into a set of slots in sets of parallel starwheels. The starwheels are in close alignment with shaped infeed buckets. A carton conveyor and a brush inserter mechanism flank and parallel the centrally located toothbrush conveyor to load the brush into a carton.

One significant aspect and feature of the present invention is a toothbrush packaging device having one or more self-regulating supply conveyor.

Another significant aspect and feature of the present invention is one or more containment slide. A further significant aspect and feature of the present invention is a clamping plate used to hold one or more toothbrushes in the containment slides.

Still another significant aspect and feature of the present invention is the use of a drop bar in conjunction with a clamping plate.

Yet another significant aspect and feature of the present invention is the precise loading of a toothbrush into slots in the starwheel assemblies.

Still a further significant aspect and feature of the present invention is the use of keeper plates with starwheels.

Yet a further significant aspect and feature of the present invention is the incorporation of infeed buckets specially shaped to accommodate the shape of a toothbrush.

Still another significant aspect and feature of the present invention is a loading arm having a configured notch for accommodation of the bristle end of a toothbrush.

Having thus described the embodiments of the present invention, it is the principal object hereof to provide a toothbrush packaging device for precise loading of toothbrushes into a carton.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
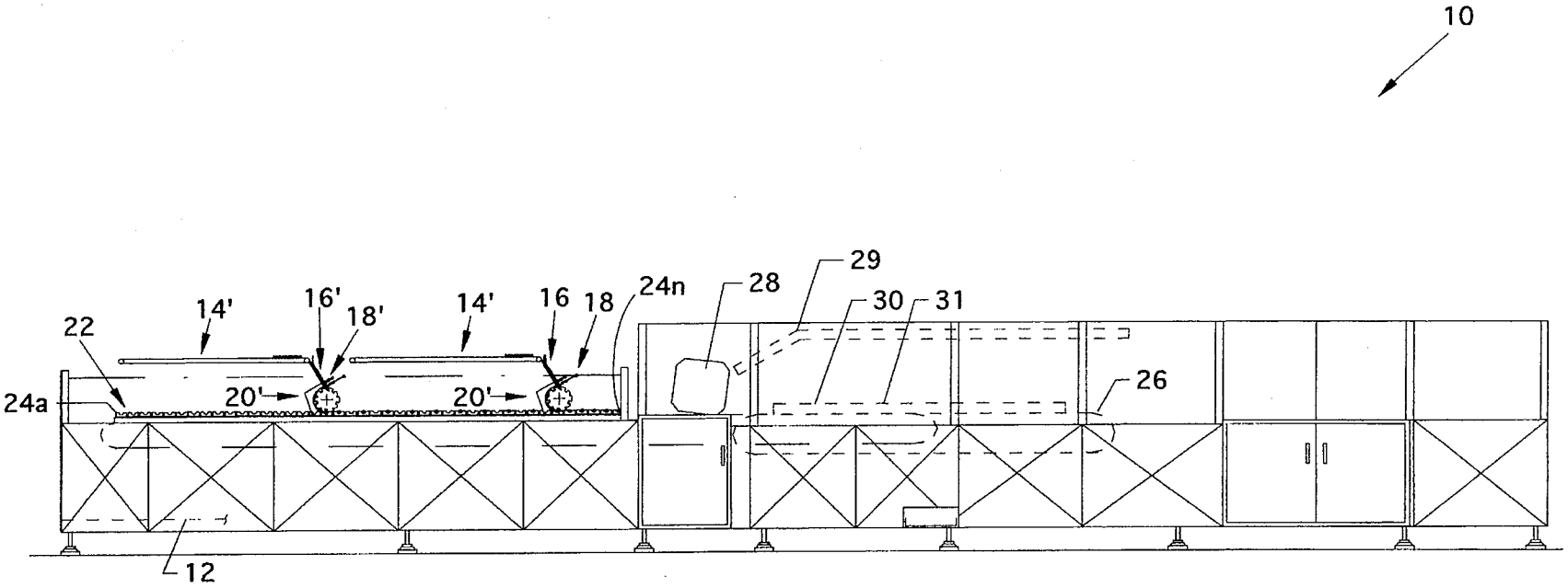
FIG. 1 illustrates a side view of the toothbrush packaging device, the present invention.

FIG. 1 illustrates a side view of a toothbrush packaging device 10, the present invention. A series of conveyors and brush handling devices are mounted on framework 12 to load a toothbrush into a package. These devices include, but are not limited to, self regulating conveyors 14 and 14' upon which toothbrushes are transported, containment slides 16 and 16' aligned between the self-regulating conveyors 14 and 14', metering mechanisms 18 and 18', starwheel loader assemblies 20 and 20', a lower toothbrush conveyor 22 having a plurality of infeed buckets 24*a*–24*n*, a carton conveyor 26, carton placer 28 located adjacent to one side of the toothbrush conveyor 22, and a carton tray 29. A brush inserter mechanism 30 and a brush backup mechanism 31, also illustrated in FIG. 2, flank the carton conveyor 26.

Figure 2:
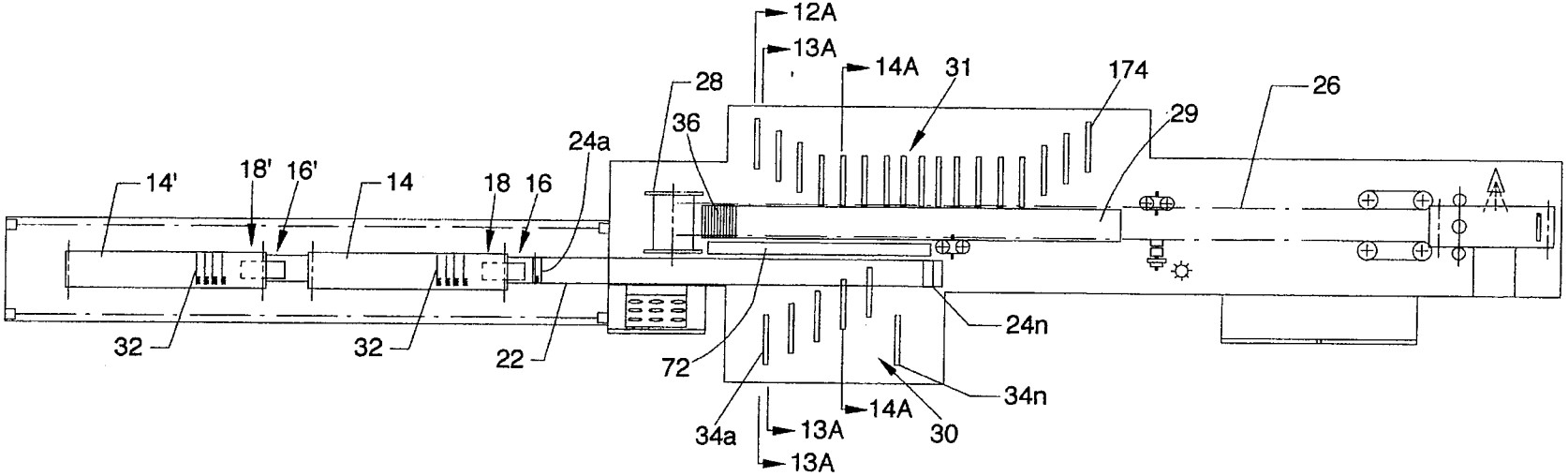
FIG. 2 illustrates a top view.

FIG. 2 illustrates a top view of the toothbrush packaging device 10 where all numerals correspond to those elements previously described. Toothbrushes 32 are loaded onto the self-regulating conveyors 14 and 14' and are delivered as required to the containment slides 16 and 16'. The toothbrushes 32 descend gravitationally in a downward fashion on the containment slides 16 and 16', and are released individually by the metering mechanisms 18 and 18' into the starwheel loader assemblies 20 and 20' illustrated in detail on the figures that follow. The starwheel loader assemblies 20 and 20' deposit each toothbrush in an alternating fashion onto one of the infeed buckets 24*a*–24*n*. The toothbrushes are conveyed by the infeed buckets 24*a*–24*n* on the toothbrush conveyor 22. The adjacent flanking carton conveyor 26, brush inserter mechanism 30, brush backup mechanism 31, and a funnel guide conveyor 72 are synchronized, aligned and moved at a rate similar to and in concert with the central toothbrush conveyor 22. A plurality of conveyored loading arms 34*a*–34*n* on the brush inserter mechanism 30 slidingly position toothbrushes 32 residing on the infeed buckets 24*a*–24*n* into the cartons 36 on the carton conveyor 26. Loading arms 34*a*–34*n* are described in detail in the figures that follow. The carton flaps are then closed by conventional means known in the art.

Figure 3:
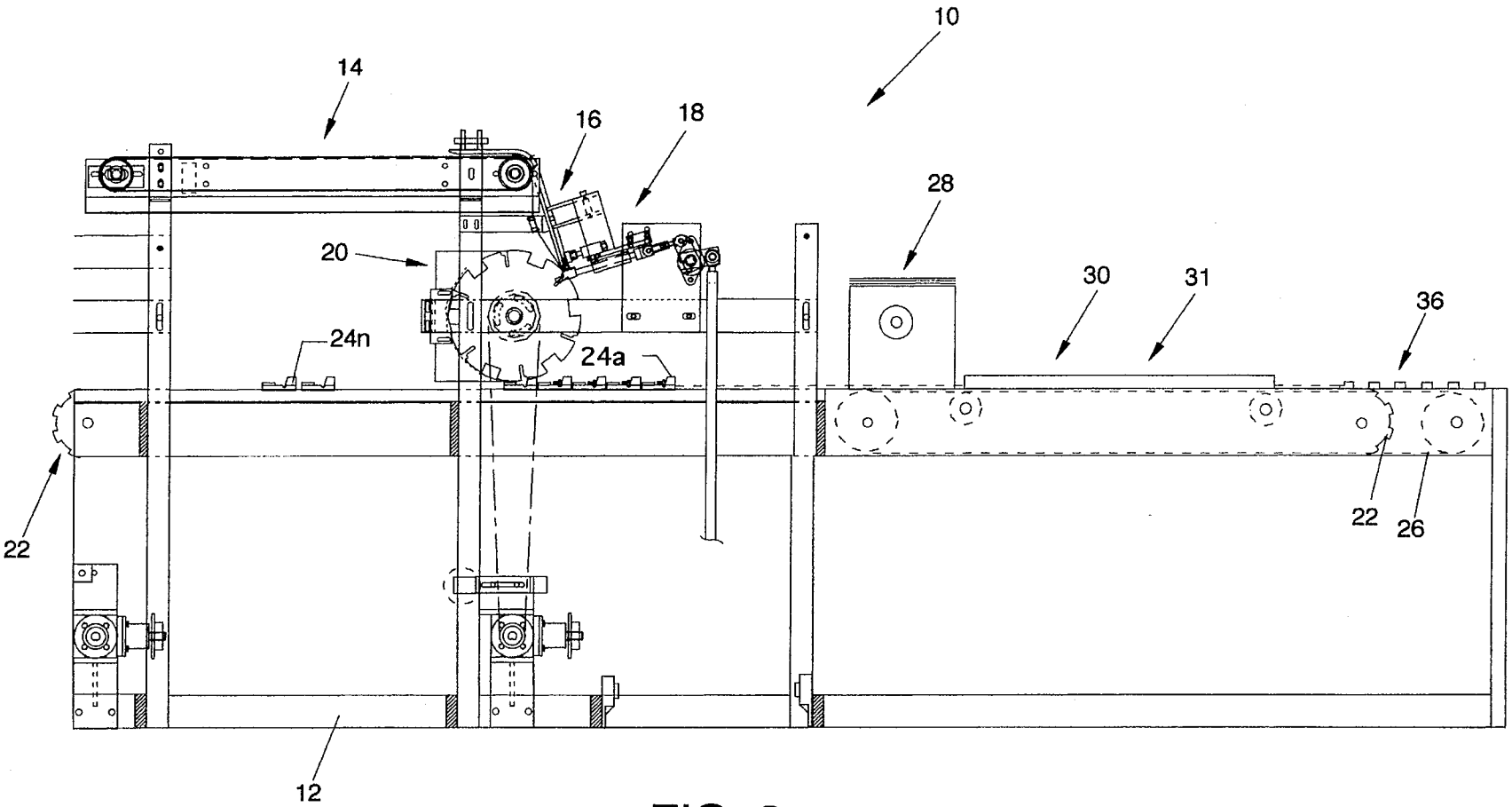
FIG. 3 illustrates a detailed view of the starwheel assembly and associated components.

FIG. 3 illustrates a detailed view of the starwheel assembly 20 and associate components which are descried in the figures that follow, and where all numerals correspond to those element previously described.

Figure 4:
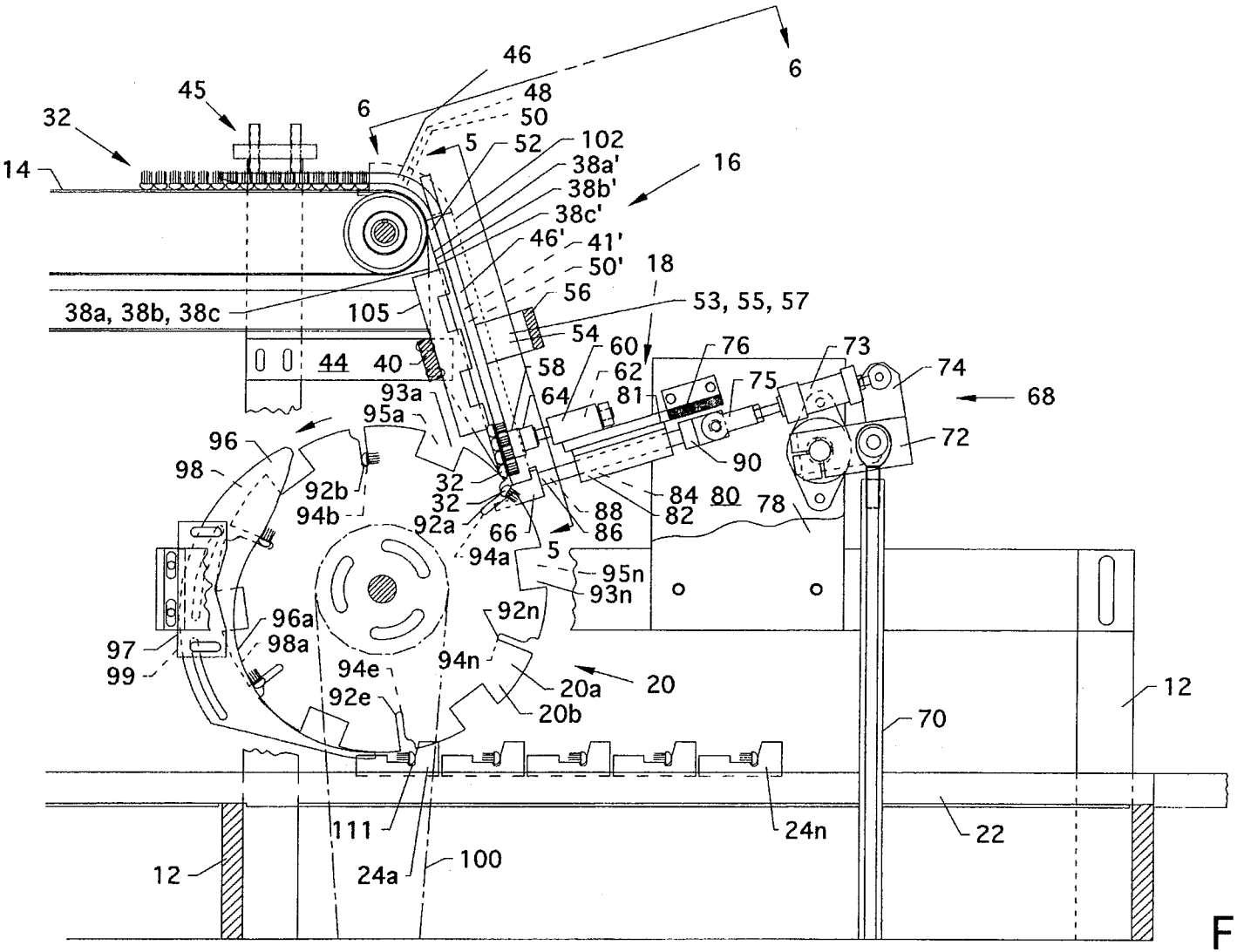
FIG. 4 illustrates a side view of the containment slider the metering mechanism and the starwheel assembly.

FIG. 4 illustrate various views of the containment slide 16, the metering mechanism 18 and other associated components. All numerals correspond to those elements previously described. The self-regulating conveyor 14 delivers a plurality of toothbrushes 32 to the containment slide 16. The containment slide 16 incorporates a plurality of slide plates including slide plates 38*a*, 38*b* and 38*c* whose sliding surfaces 38*a'*, 38*b'* and 38*c'* are mounted an appropriate number of degrees from the vertical. The slide plates 38*a*–38*c* are positionally secured on a slotted hole horizontally oriented mounting bar 40 suspended between slotted vertically adjustable bars 42 and 44. A plurality of containment guide rods 46, 48 and 50 having curved ends extend horizontally over and are adjustably supported by a bracket 45 at the end portion of the self-regulating conveyor 14, and then conformingly curve about the end roller radius of the self-regulating conveyor 14 align with containment guide rods 46', 48' and 50' to parallel the sliding surfaces 38*a'*, 38*b'* and 38*c'* of the slide plates 38*a*–38*c*. A slot area 52 is formed between the sliding surfaces 38*a'*38*c'* and the parallel portion of the rod containment guide members 46', 48' and 50'. The containment guide members 46', 48' and 50' are adjustably mounted to a slotted bar 54 and another bar 56. Support bars 53, 55 and 57 extend from the bar 56 to support the rod containment guide members 46', 48' and 50'. Toothbrushes 32 align in and descend vertically aided by gravitational forces. A sensor (not illustrated), senses the level of brushes 32 in the slot area 52 to activate the self-regulating conveyor 14 to supply toothbrushes 32 as required. A plate 58 actuated by pneumatic actuators 60 and 62 and 5an interspersed coupling bar 64 holds one or more toothbrushes 32 against the slide plates 38*a*–38*c*. The pneumatic actuators 60 and 62 are activated to allow one toothbrush at a time to be released to further descend in the lower region of the slot area 52 until contacting a horizontally aligned drop bar 66. The drop bar 66 is actuated horizontally by a rod linkage assembly 68 including a rod 70, a crank arm 72, a crank arm 74, a pneumatic dampener cylinder 73, and a rod 75. A support bar 76 adjustably mounts to frame members 78 and 80 and serves as a mount for a plate 81. Rod guides 82 and 84 and pneumatic actuators 60 and 62 secure to the plate 81. Dual actuating rods 86 and 88 align in the rod guides 82 and 84 and are bussed together by a traverse bar 90. The pneumatic dampener cylinder 73 serves to lessen rod linkage over load should the drop bar impinge upon a jammed or otherwise misaligned toothbrush entering the slotted members of the starwheel, such as 20*a* and 20*b* or the like. As the drop bar 66 is retracted to the right by action of the rod and linkage assembly 68, the toothbrush 32 resting thereupon is released downwardly into slots 92*a* and 94*a* of the starwheels 20*a* and 20*b*, and is aligned with the bristles pointing in a downward position due to the geometry and shape of the drop bar 66 and the slots 92*a* and 94*a* of the starwheels 20*a* and 20*b*. Vertically and 98 having curved semicircular surfaces 96*a* and 98*a* secure to the framework by slotted brackets 97 and 99 and closely align adjacent to the starwheels 20*a* and 20*b* to cause the toothbrushes 32 to remain in the slots 92*a*–92*n* and 94*a*–94*n* as the slots descend below the horizontal position. Starwheels 20*a* and 20*n* are rotationally driven by a chain 100, and are synchronized and aligned with the configured shape infeed buckets 24*a*–24*n* on the toothbrush conveyor 22 so that as the slots 92*a*–94*a* through 92*n*–94*n* exit the confines of the keeper plates 96 and 98, the toothbrushes 32 are simultaneously deposited in the aligned infeed buckets 24*a*–24*n*. Starwheels 20*a* and 20*b* also include corresponding cutouts 93*a*–93*n* and 95*a*–95*n* interspersed with corresponding slots 92*a*–92*n* and 94*a*–94*n*, respectively. These cutouts 93*a*–93*n* and 95*a*–95*n* provide clearance with a toothbrush in one of the infeed buckets 24*a*–24*n* should that infeed have a toothbrush residing therein.

Figure 5:
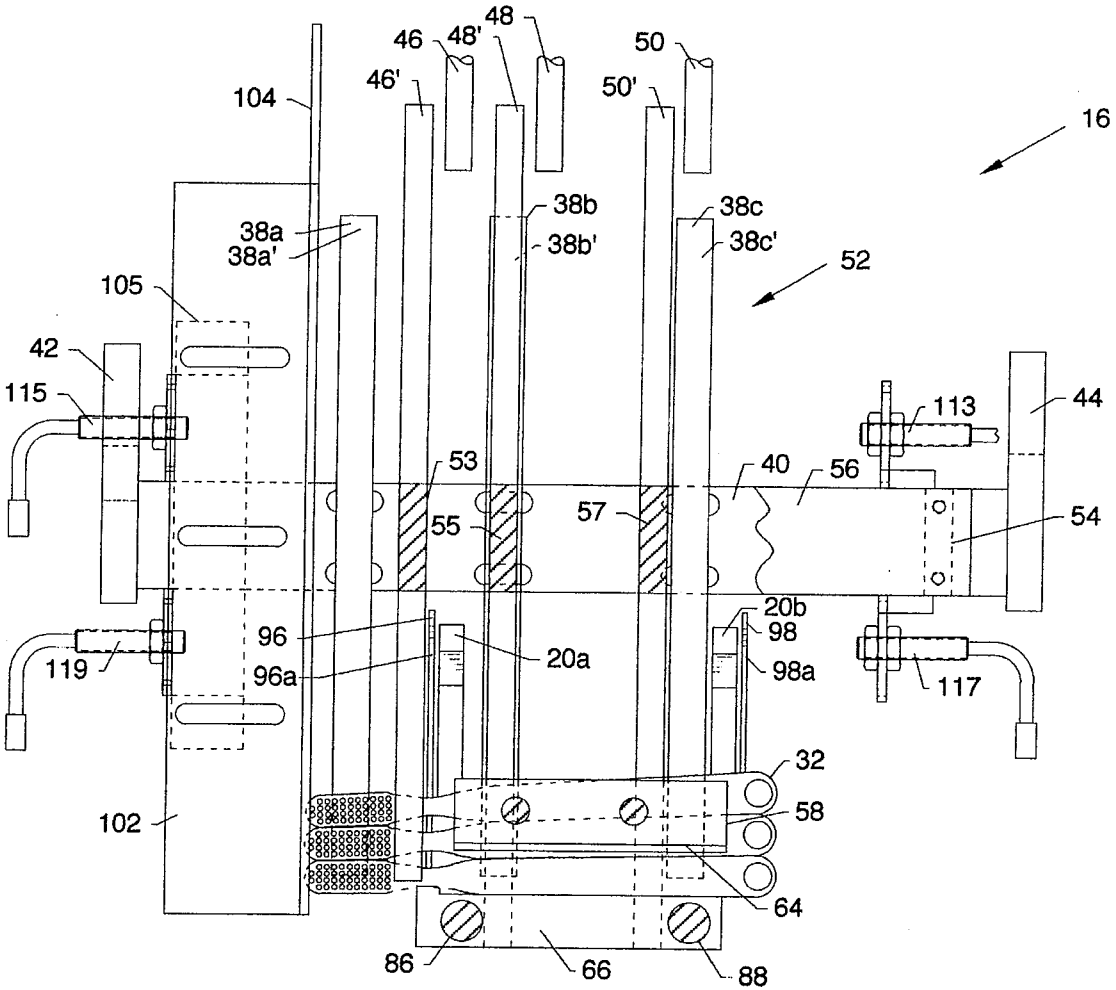
FIG. 5 illustrates a view of the containment slide along line 5—5 of FIG. 4.

FIG. 5 illustrates a view of the containment slide 16 along line 5—5 of FIG. 4 where all numerals correspond to those elements previously described. Illustrates in particular are the slide plates 38*a*–38*c* adjustably secured in a plurality of slotted holes in the mounting bar 40. A guide assembly 102 having a vertical guide surface 104 adjustably mounts to the mounting bar 40 via a bracket 105 to maintain alignment of the toothbrushes 32 within the slot area 52. The guide assembly 102 is also shown in dashed lines in FIG. 4. Sensors are illustrated in this figure and mount appropriately in alignment with the slot area 52 illustrated in FIG. 4 to detect the status of toothbrushes 32 aligned in the slot area 52. An upper level sensor transmitter 113 and sensor receiver 115 sense the presence or absence of toothbrushes in the mid-region of the slot area 52, and a lower level sensor transmitter 117 and sensor receiver 119 sense the pressure or absence of toothbrushes 32 in the lower region of the slot area 52. The conveyor 14 of FIG. 4 is appropriately actuated to replenish the supply of toothbrushes 32 in the slot area 52 as a result of the sensing at the mid and lower regions of the slot area 52.

Figure 6:
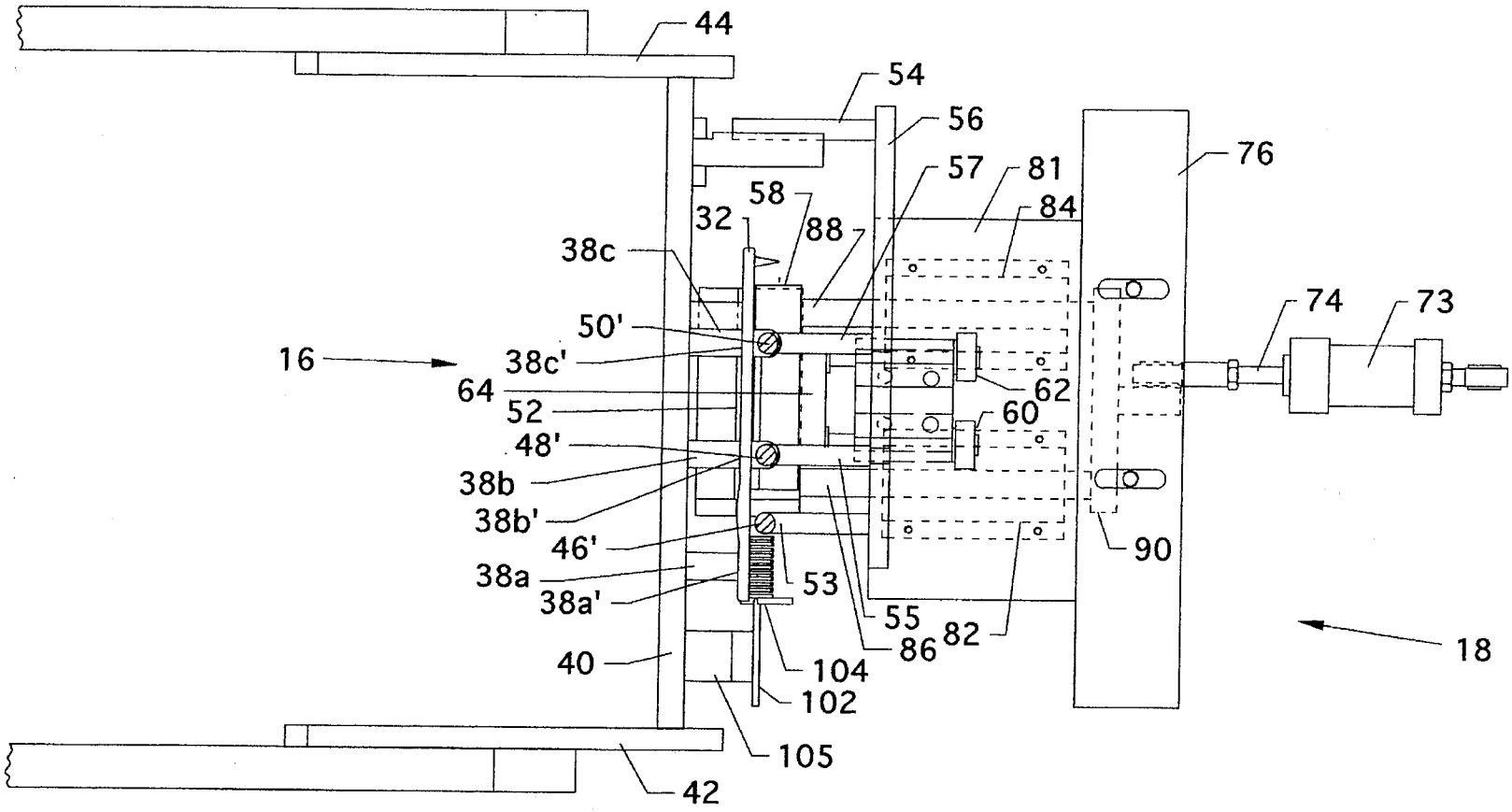
FIG. 6 illustrates a top view of the containment slide and metering mechanism along line 6—6 of FIG. 4.

FIG. 6 illustrates a top view of the containment slide 16 and the metering mechanism 18 along view line 6—6 of FIG. 4 where all numerals correspond to those elements previously described. Illustrated in particular is a toothbrush 32 being held against the slide plates 38a–38c by the actuated plate 58. The plate 58 includes recesses 58a and 58b being spaced about the rod containment guides 48 and 50, respectively. Also illustrated are the pneumatic actuators 60 and 62 and rod guides 82 and 84 on plate 81.

Figure 7:
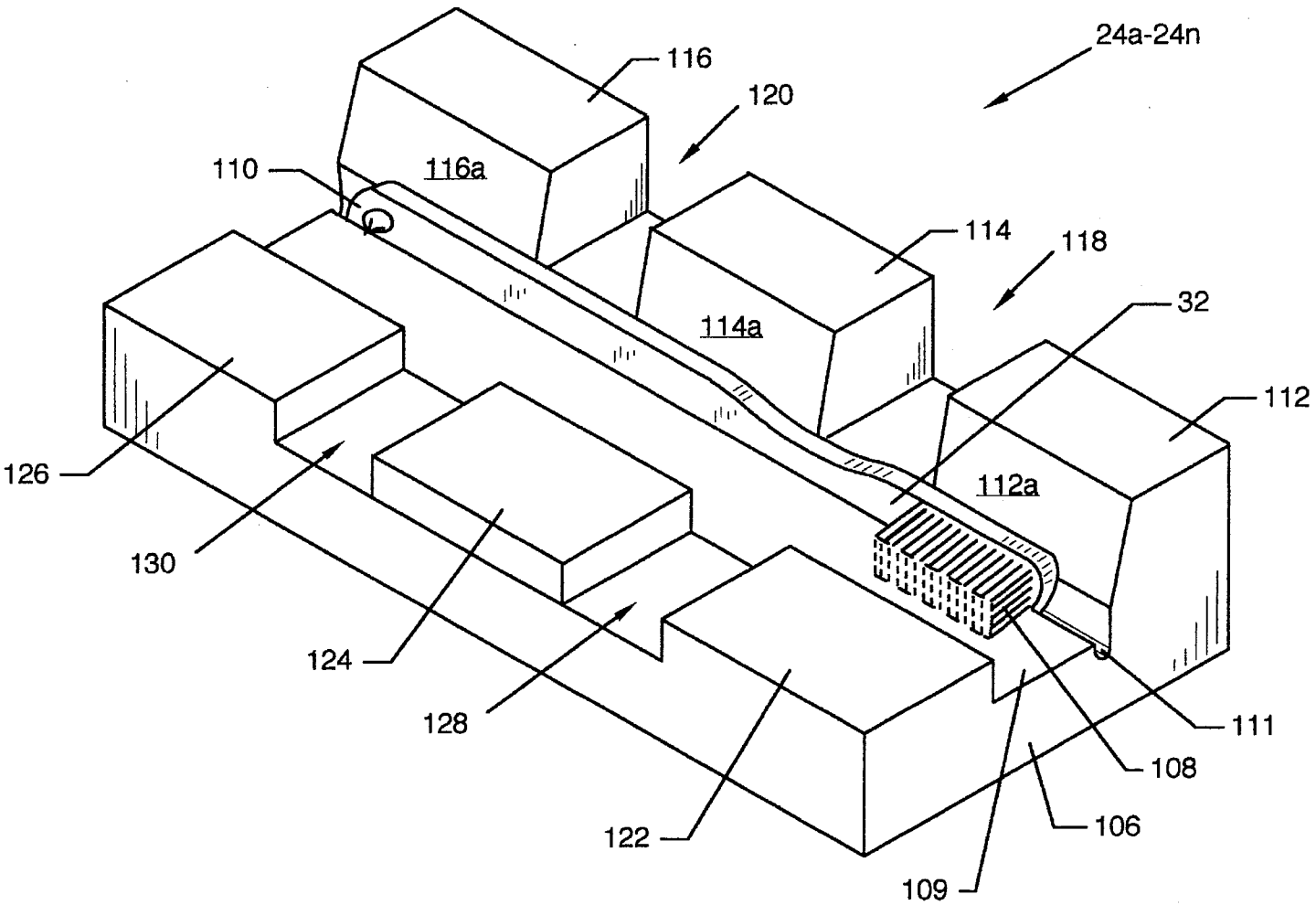
FIG. 7 illustrates a perspective view of an infeed bucket.

FIG. 7 illustrates a perspective view of one of the infeed buckets 24a–24n. The buckets 24a–24n include a body 106 having a configured shape which conforms to the geometrical shape of a toothbrush 32 having bristles 108 and a handle 110. A recessed planar surface 109 provides support for the bristle 108 sides as illustrated. A groove or channel 111 provides support for an edge of the toothbrush handle 110. Rectangular solid like shaped extensions 112,114 and 116 extend upwardly from the body 106 and have starwheel clearance spaces 118 and 120 therebetween and also include angled and beveled surfaces 112a, 114a and 116a intersecting the groove or channel 111 to assist in alignment and placement of the brushes 32 from the starwheel loader assembly 20 as illustrated in FIG. 8. Rectangular solid like extensions 122, 124 and 126 extend upwardly from the body 106 and include starwheel clearance spaces 128 and 130 therebetween.

Figure 8A:
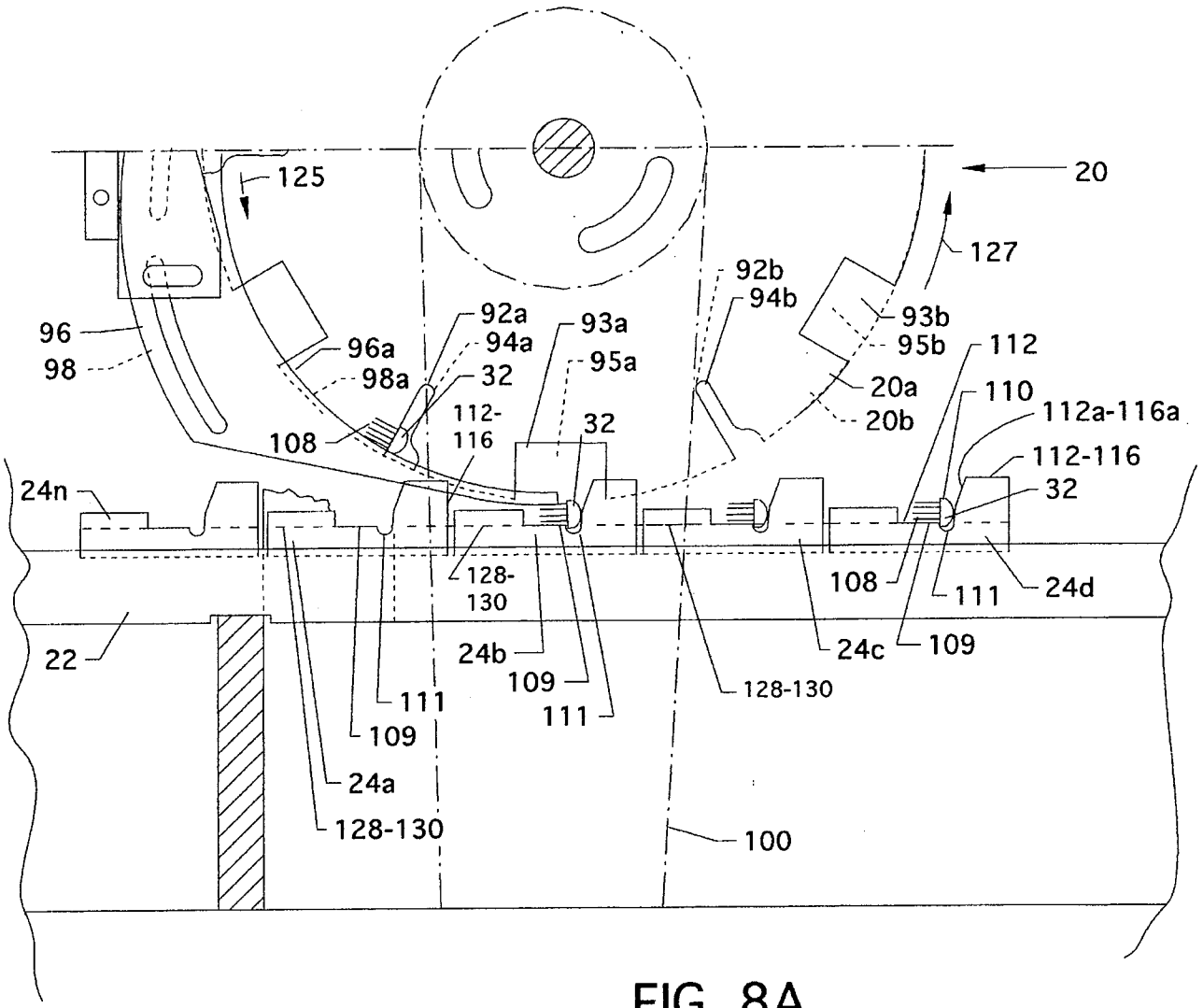
FIG. 8A–8B progressively illustrates the placement of a toothbrush from a starwheel loader assembly to an infeed bucket.
Figure 8B:
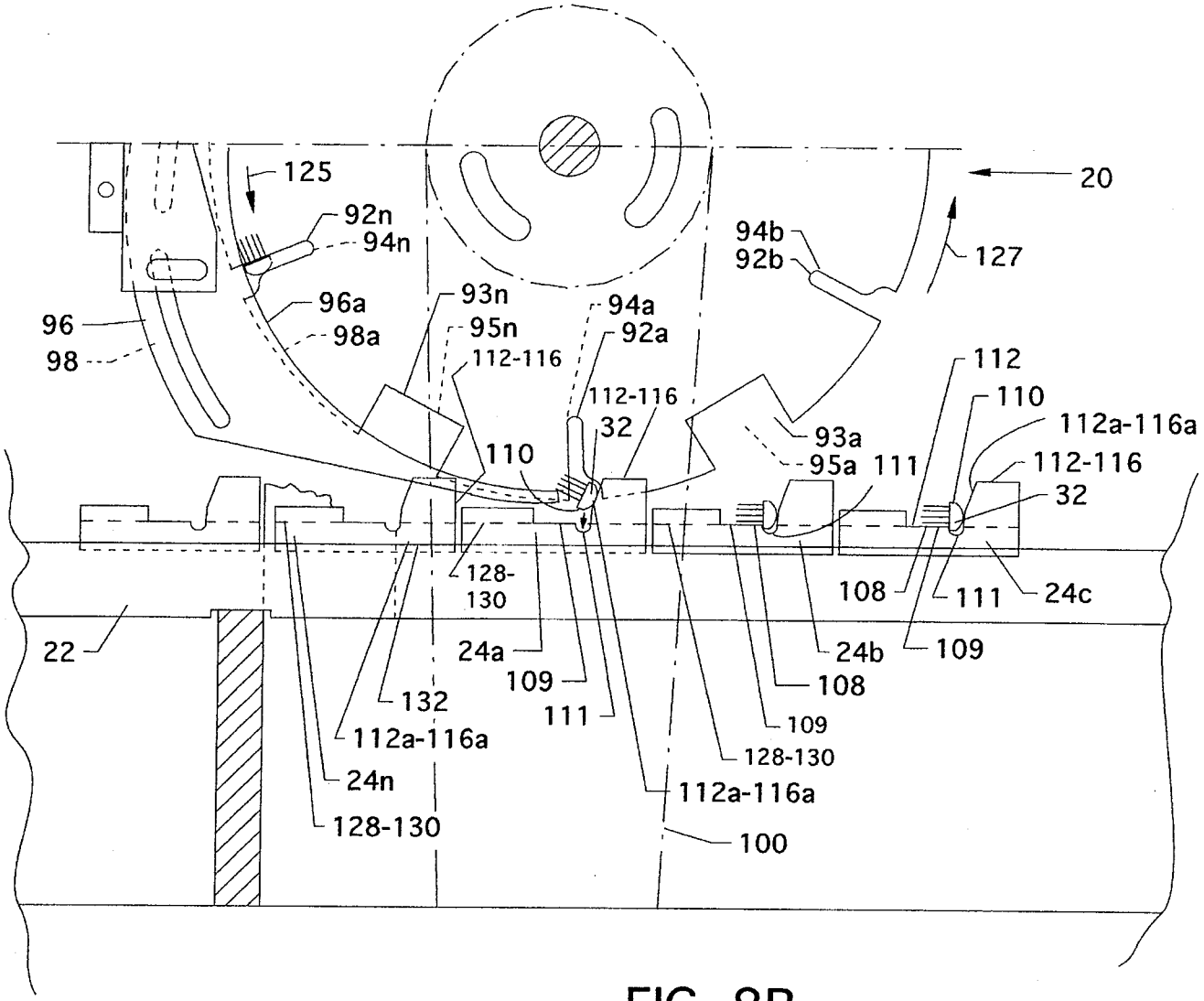

FIG. 8A and 8B progressively illustrate placement of a toothbrush 32 from a second starwheel loader assembly 20 to an infeed bucket 24a where all numerals correspond to those elements previously described. The illustrated second starwheel assembly 20 and the first starwheel 20' operate in a similar fashion and manner, and have like and corresponding reference numerals for purposes of clarity and brevity. The starwheels 20a and 20b are rotated as indicated by arrows 125 and 127 and align a toothbrush 32 in the slots 92a and 94a with the infeed bucket 24a. During rotation of the starwheels 20a–20b, the slots 92a and 94a position the toothbrush 32 as an ever increasing radius track until reaching a point beyond and past the influence of the semicircular surfaces 96a and 98a of the keeper plates 96 and 98, respectively, and the toothbrush 32 is allowed to be released from the starwheel slots 92a and 94a. During this release gravitational forces cause the toothbrush 32 to descend to a position where the handle 110 evenly and slidingly engages the angled surfaces 112a–116a of the upright extensions 112–116. The toothbrush 32 then continues its downward sliding movement so that the lower edge of the handle 110 engages the groove 111 and so that the lower bristles 108 engage and rest upon the planar surface 109 of the infeed bucket 24a the final position of which is also illustrated at infeed bucket 24b of FIG. 8B for purposes of illustration. This final engaged position of a toothbrush 32 is also illustrated in the infeed bucket 24c down line of infeed buckets 24C, and 24b.

In FIG. 8A it is also noted that a toothbrush 32 has been previously loaded into the infeed bucket 24b by the upline starwheel assembly 20'. The cutouts 93a and 95a provide clearance between the previously loaded toothbrush 32 in the infeed bucket 24b. Clearance between the starwheel members 20a–20b is provided by the clearance spaces 118, 120, 128 and 130 as previously described in FIG. 7.

Figure 9:
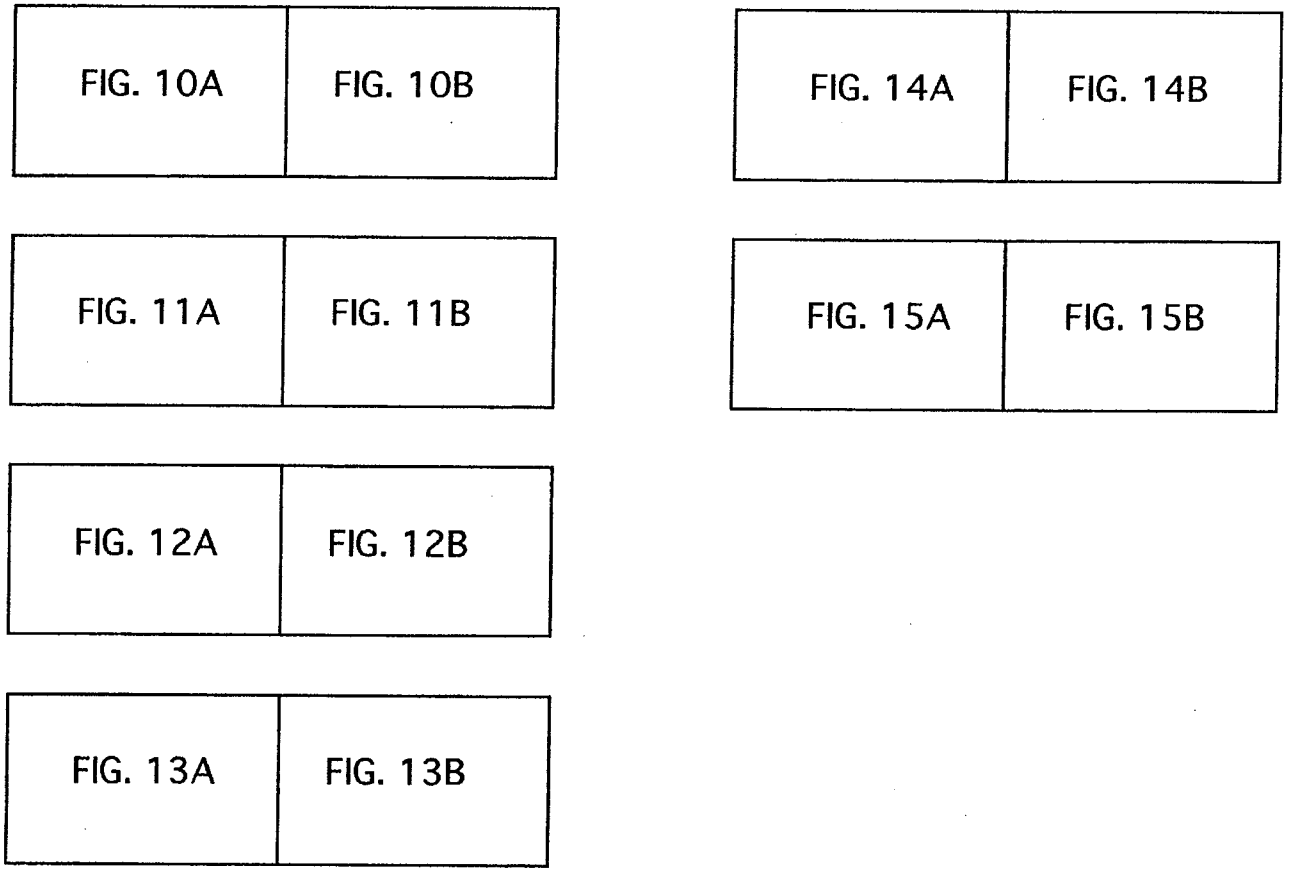
FIG. 9 illustrates the alignment of FIGS. 10A–10B, 11A–11B, 12A–12B, and 13A–13B.

FIG. 9 illustrates the alignment of FIGS. 10A–10B, 11A–11B, 12A–12B, 13A–13B, 14A–14B and 15A–15B.

Figure 10A:
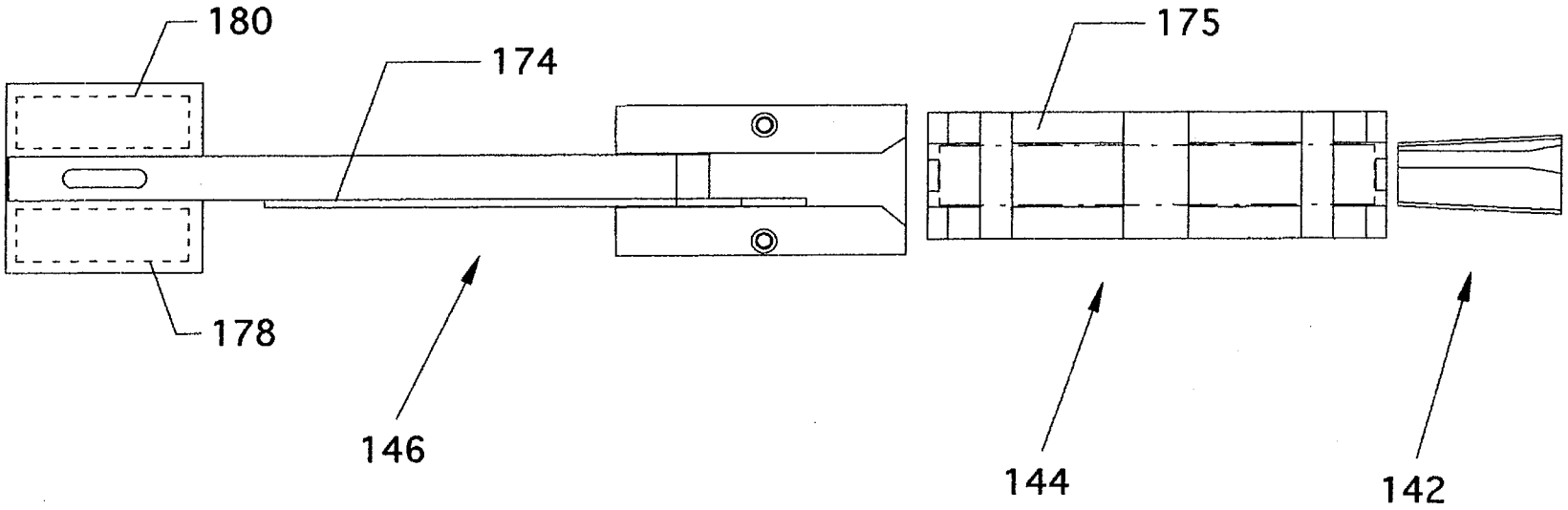
FIGS. 10A–10B illustrate a top view of conveyored loading arm conveyors and associated adjacent components.
Figure 10B:
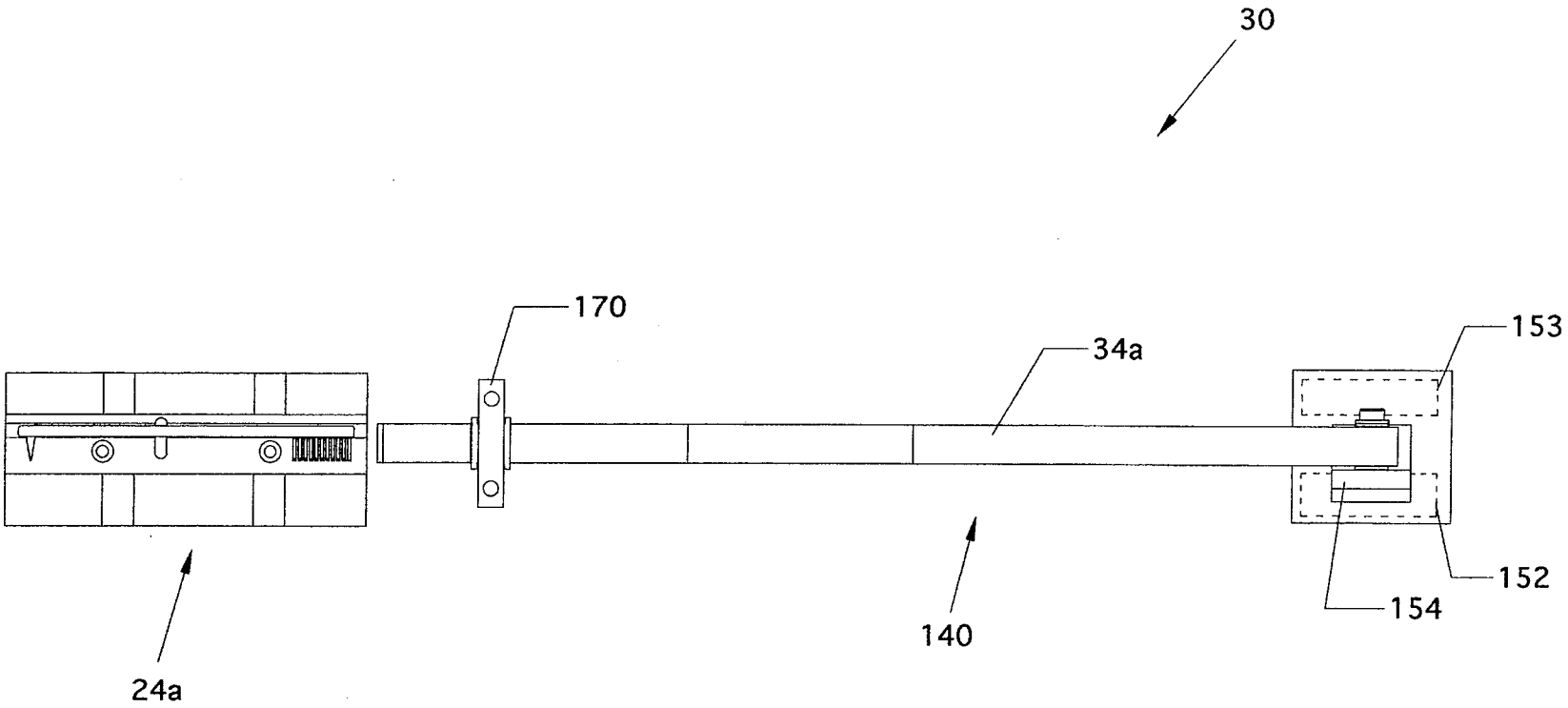

FIGS. 10A–10B illustrate a top view of a single conveyored loading arm 34a of the toothbrush inserter mechanism 30 of FIG. 1 where all numerals correspond to those elements previously described. Included are a conveyored toothbrush load gate 140 having toothbrush loading arm 34a a conveyored infeed bucket 24a, a conveyored funnel guide 142, a conveyored carton flight 144, and a conveyored toothbrush positioner gate 146 a plurality of tamper arms 174. Additional actuation, guidance and structure members for operation of the conveyored loading arm 34a are illustrated in the figures that follow, but are not included in the top views for the purpose of brevity and clarity.

Figure 11A:
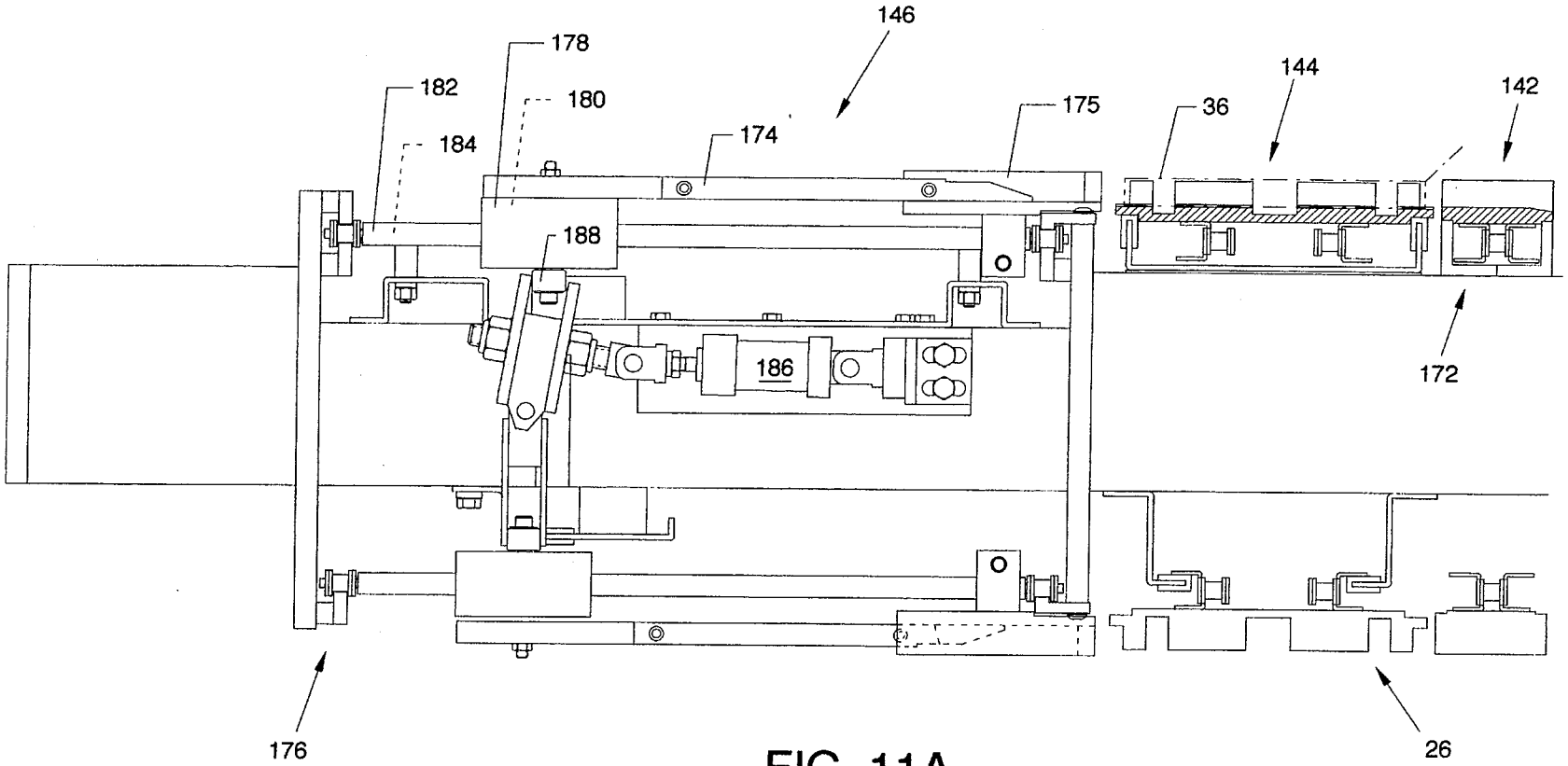
FIG. 11A–11B illustrate a side view in partial cross section of a single conveyored loading arm prior to loading of the toothbrush into a carton.
Figure 11B:
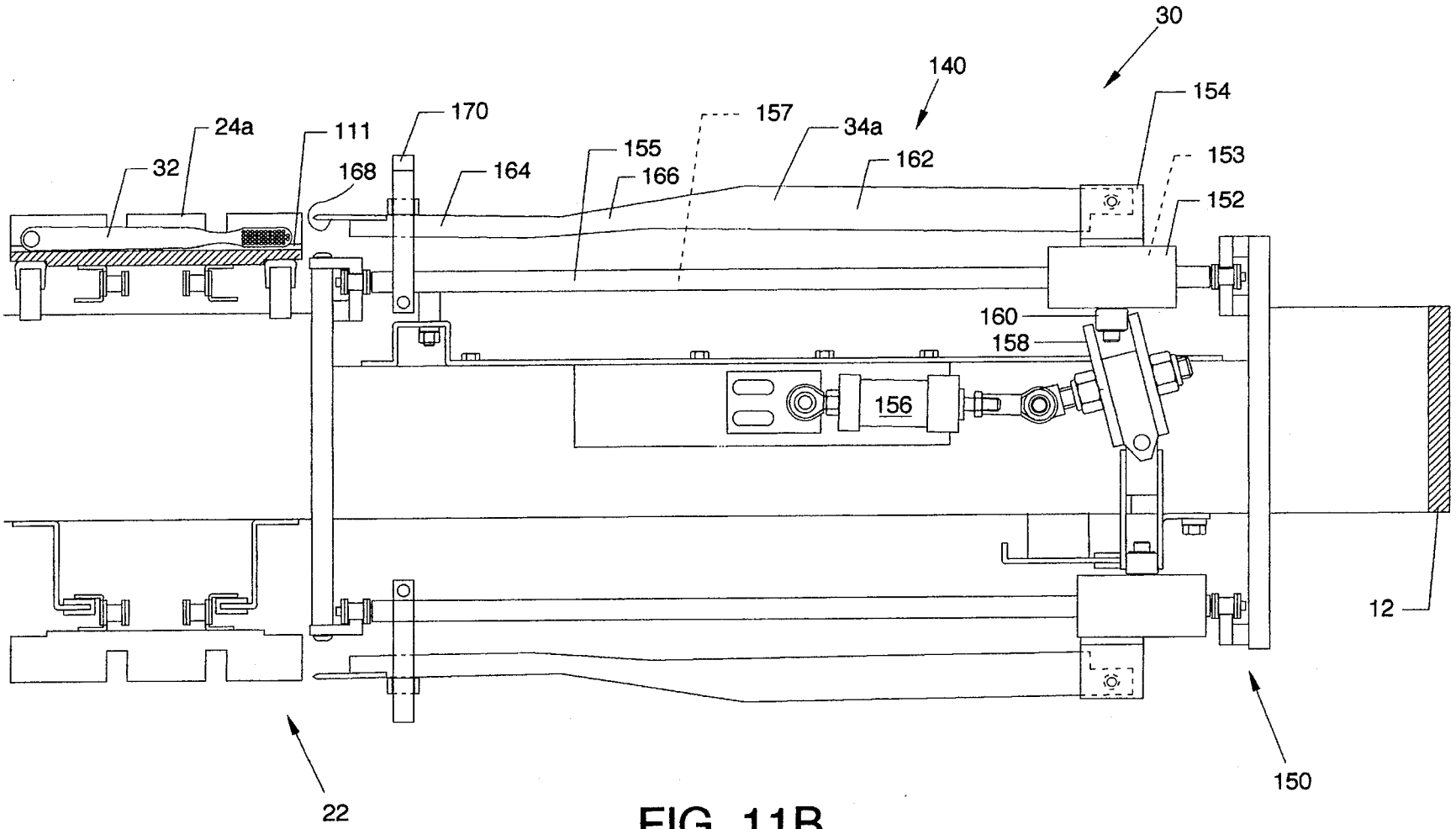

FIGS. 11A–11B illustrate a slide view in partial cross section of a single conveyored loading arm 34a of the brush inserter mechanism 30 where all numerals correspond to those elements previously described. A plurality of the conveyored loading arms 34a and associated components align about the load gate conveyor 150 to sequentially load a plurality of toothbrushes 32 into a plurality of cartons 36 on the carton conveyor 26. The conveyored toothbrush load gate 140 includes a series of geometrically configured horizontally positionable loading arms such as arm 34a which travel about a conveyored load gate conveyor 150. The loading arm 34a pivotally secures to a pair of bearinged slides 152 and 153 via a connecting pivot block 154. The bearinged slides 152 and 153 and associated components traverse horizontally along supported rods 155 and 157. An actuating cylinder 156 and channel 158 direct a cam 160 connected between the bearinged slides 152 and 153 to cause the loading arm 34a, the pivot block 152 and the bearinged slides 152 and 153 to slide along the supported rods 155 and 157 and to either be active or inactive in the loading process. Other actuator cams or devices known in the art further activate the loader arms 34a further inwardly to horizontally position the toothbrush 32 as illustrated later in detail. The sliding loader arm 34a is illustrated in the inactive mode. Loading arm 34a includes two horizontal arm portions 162 and 164 with an angled arm portion 166 between the horizontal arm members 162 and 164. A notched end 168 is included at the end of the horizontal arm portion 164 to accommodate the bristle end of the toothbrush 32. The notched end 168 of the loading arm 34a aligns in a guide structure 170.

The toothbrush conveyor 22 aligns with the load gate conveyor 150. A toothbrush 32 is illustrated resting in the infeed bucket 24a in readiness for loading into the carton 36 on the aligned carton conveyor 26. A funnel guide conveyor 172 having a plurality of conveyored funnel guides 142 aligns between the toothbrush conveyor 22 and the carton conveyor 26.

A conveyored toothbrush positioner gate 146 aligns with the carton conveyor 26 and works much in the same manner as the mechanism of the conveyored toothbrush load gate 140. The conveyored toothbrush positioner arm 146 includes a plurality of conveyored horizontally positionable tamper arms such as tamper arm 174 which travels about a toothbrush positioner conveyor 176. The tamper arm 174 secures between a pair of bearinged slides 178 and 180 and slidingly engage a guide structure 175. The bearing slides 178 and 180 and associated components traverse horizontally along support rods 182 and 184. An actuating cylinder 186 direct a cam 188 connected between the bearinged slides 178 and 180 to cause the tamper arm 174 and the bearinged slides 178 and 180 to slide along the support rods 182 and 184 and to be active or inactive in the loading process. Other actuator cams or devices known in the art further activate the tamper arms 174 horizontally to position a toothbrush as later described in detail.

Figure 12A:
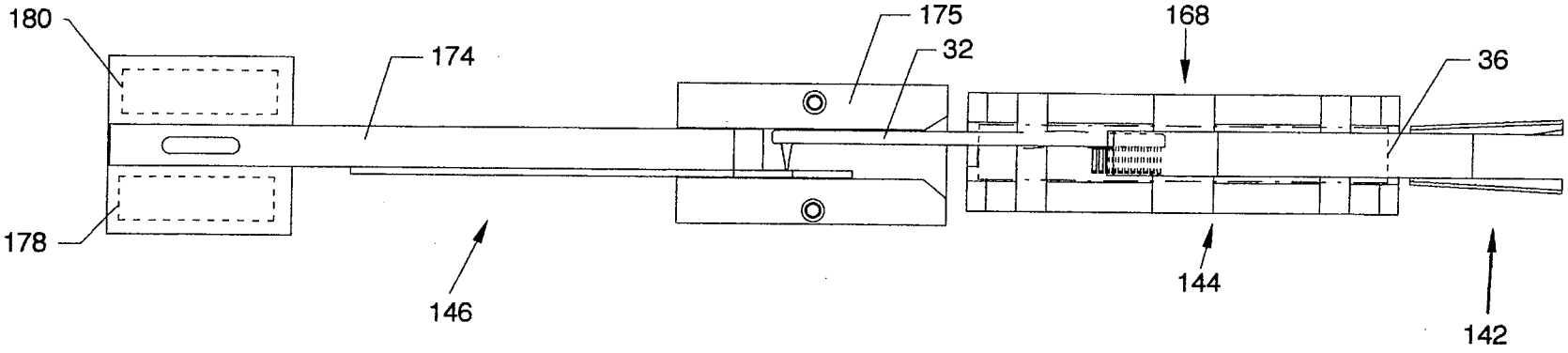
FIGS. 12A–12B illustrate a top view of an activated single conveyored loading arm during the first stage of carton loading where the toothbrush is loaded into and past the confines of the carton.
Figure 12B:
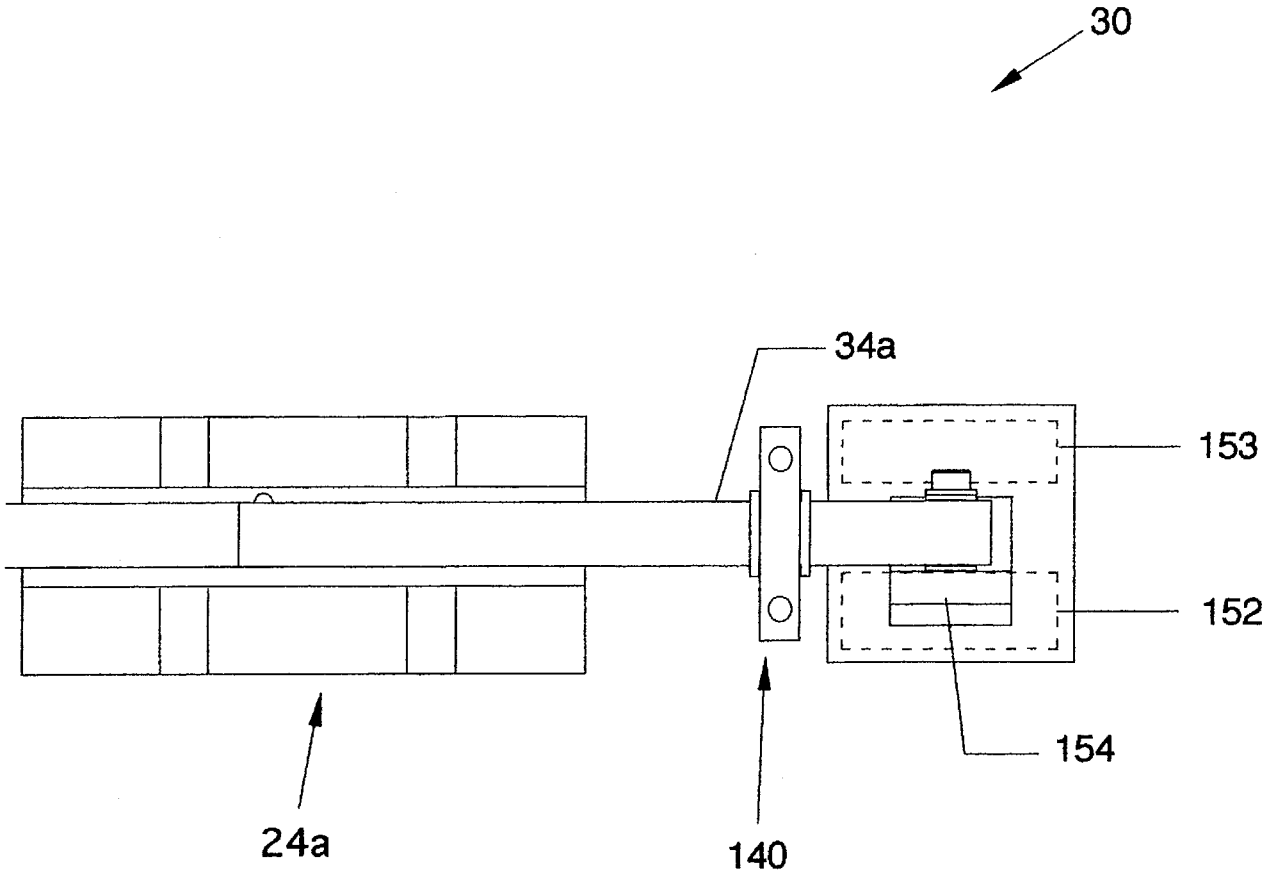
Figure 13A:
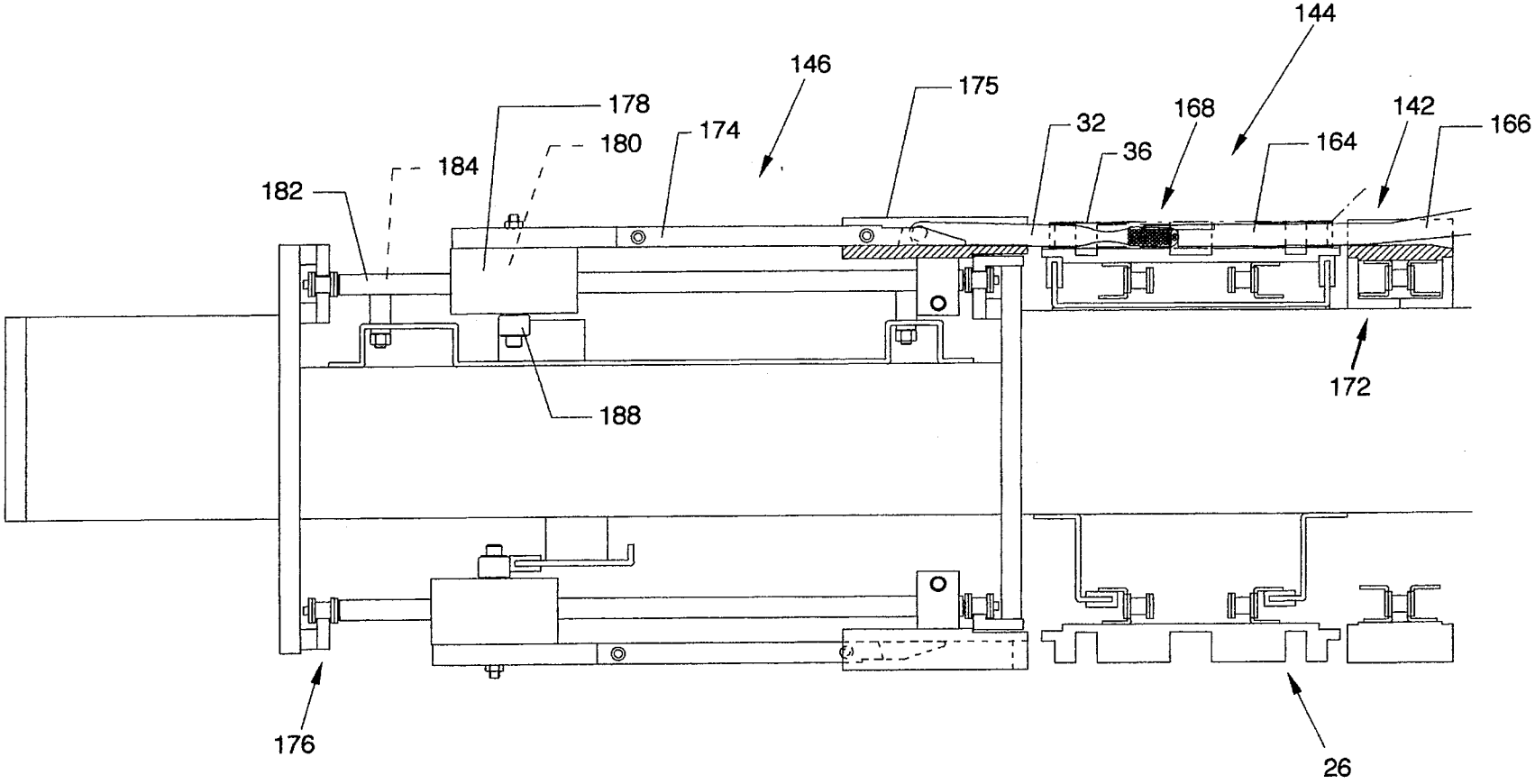
FIGS. 13A–13B illustrate a side view in partial cross section of the toothbrush being inserted into and past the carton during the first stage of carton loading by the single activated conveyored loading arm.
Figure 13B:
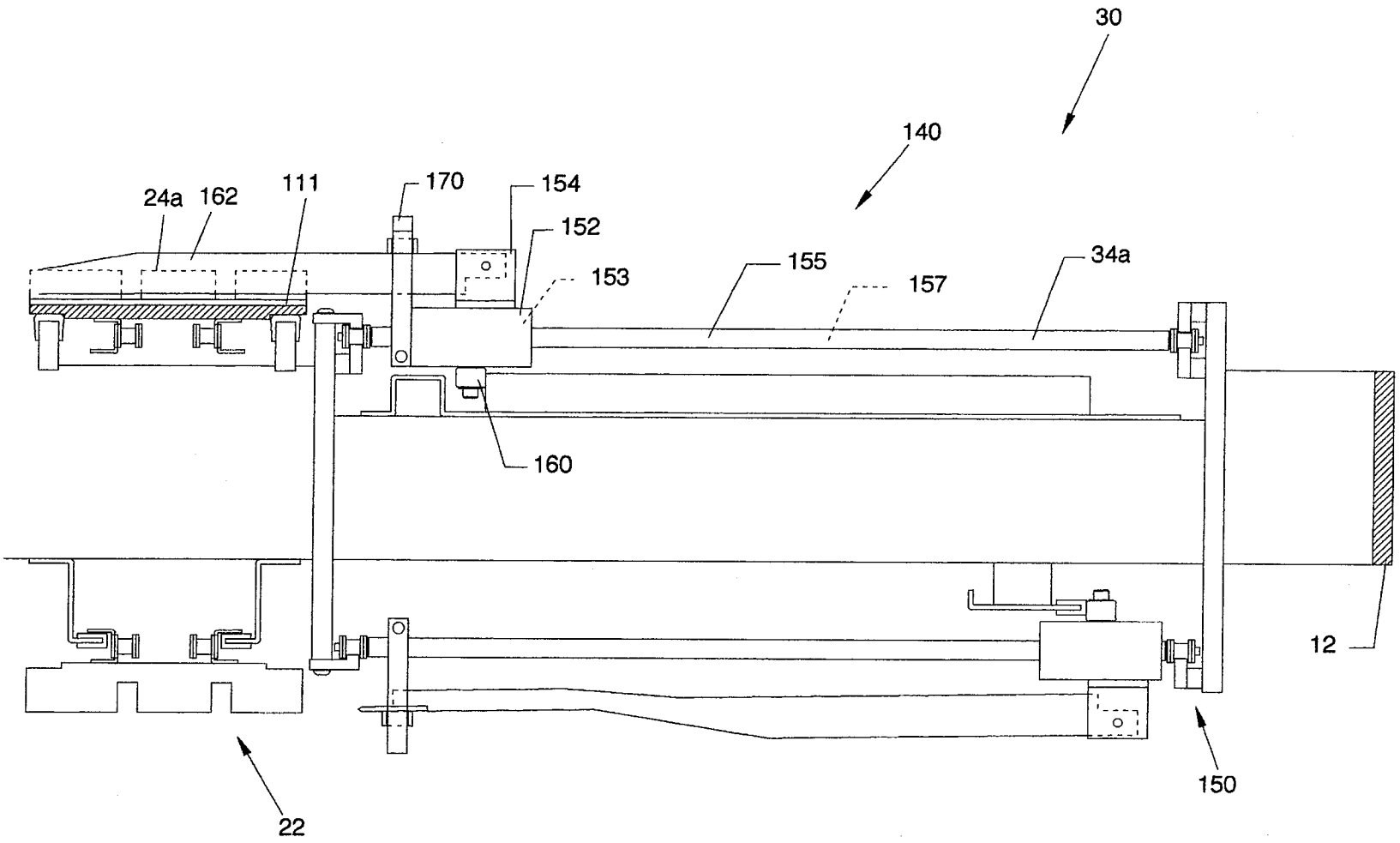

FIGS. 12A–12B illustrates a top view and FIGS. 13A–13B illustrates a side view in partial cross section of an activated single conveyored loading arm 34a of the brush inserter mechanism 30 during the first stage of carton loading where all numerals correspond to those elements previously described. Certain members illustrated in previous figures have not been illustrated for purpose of brevity and clarity. During the first stage of carton loading, the load gate conveyor 150 diverts or otherwise guides the end of the loading arm 34*a* having the conforming notched end 168 to align the conforming notch with the geometry of the toothbrush 32. The notched end 168 contacts the upper plastic edge of the toothbrush 32 and also contacts the upper and leading bristles to provide intimate brush to load arm contact, thus precluding brush misalignment as it travels horizontally across the infeed bucket 24*a*. After brush contact has been made, notched end 168 drops down onto the head of the brush, thus assuring that the brush 32 cannot roll over on its back or otherwise be misaligned after entering the cartons. A view of the notched end 168 prior to toothbrush engagement is included in FIG. 11B. The loading arm 34*a* is actuated fully inwardly as illustrated to move the toothbrush 32 from the notch 111, along and through the conveyored funnel guide 142 and into and partially beyond the confines of the carton 36 held in a carton flight such as the conveyored carton flight 144 on the carton conveyor 26.

Figure 14A:
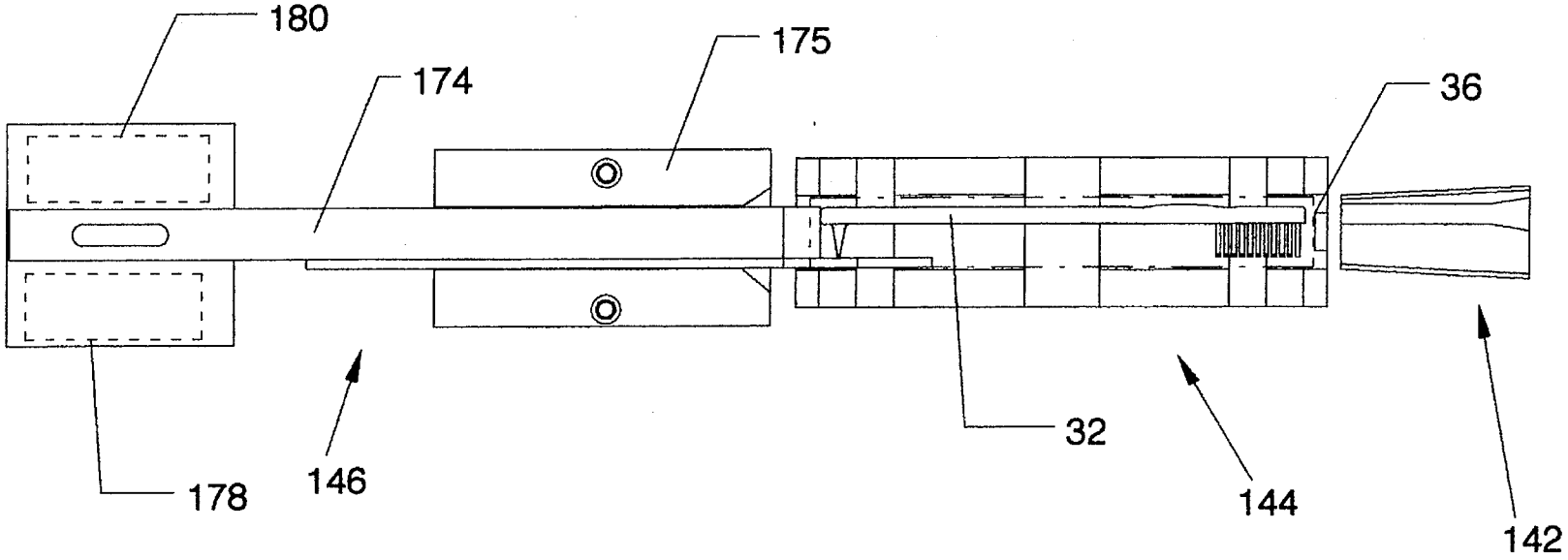
FIGS. 14A–14B illustrates a top view of an activated conveyored tamper positioner arm during the second stage of carton loading where the toothbrush is repositioned fully into the confines of the carton; and, FIGS. 15A–15B illustrates a side view of an activated conveyored tamper positioner arm during the second stage of carton loading where the toothbrush is repositioned fully into the confines of the carton.
Figure 14B:
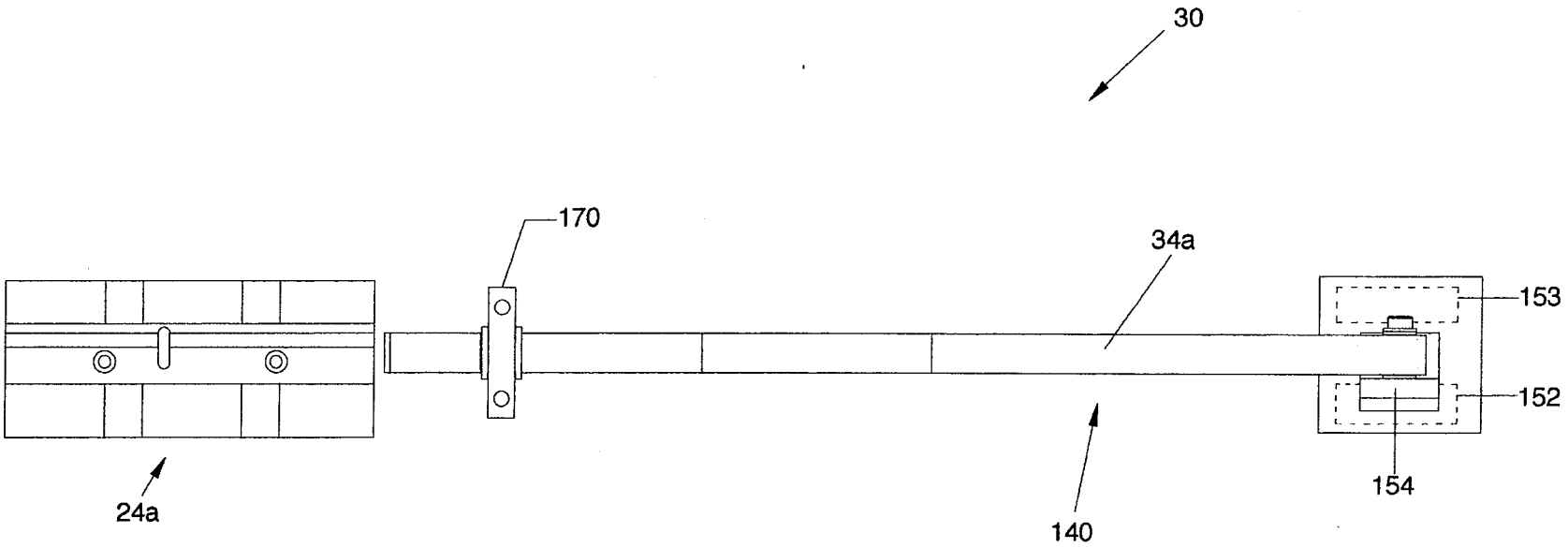
Figure 15A:
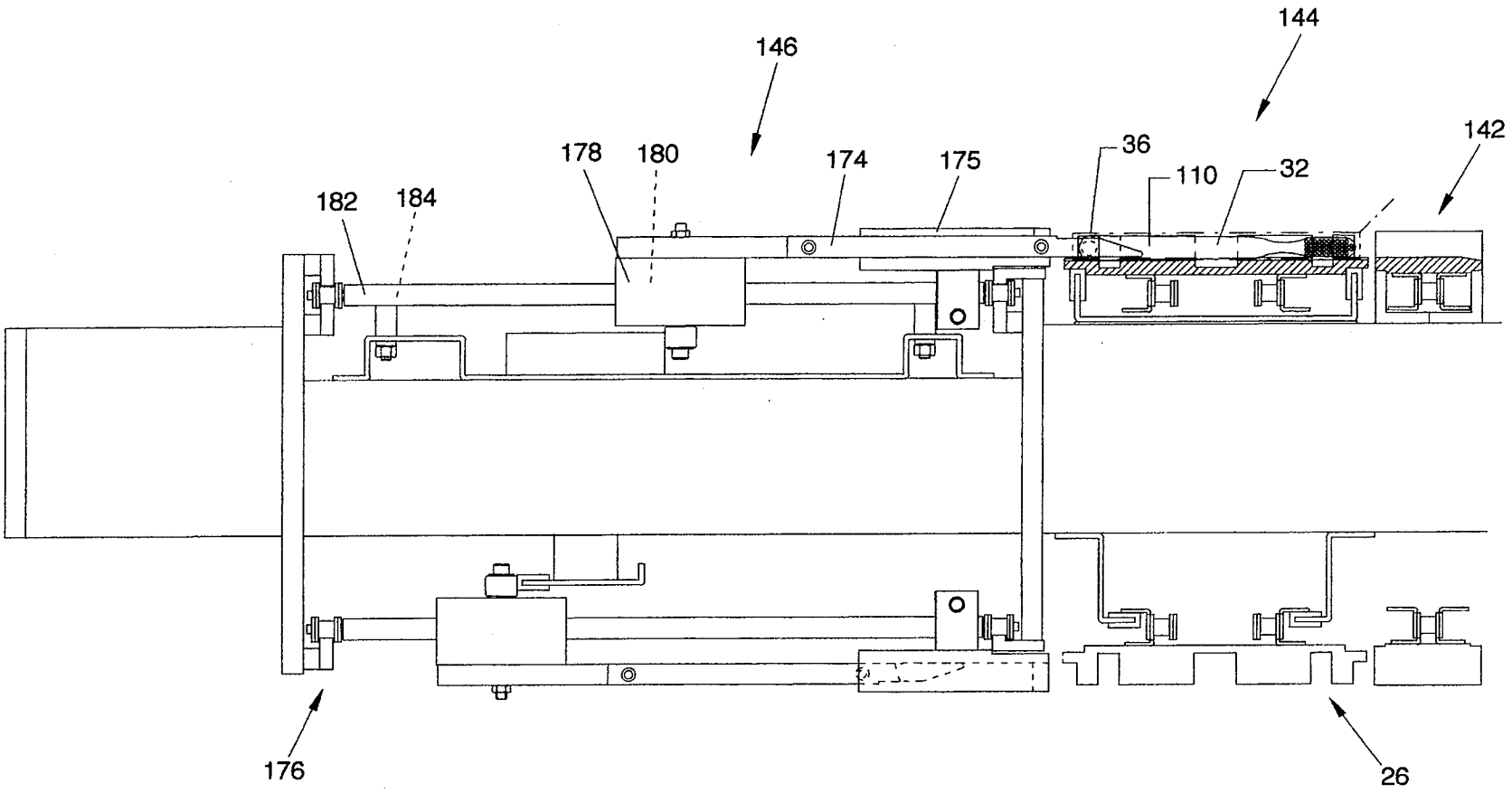
Figure 15B:
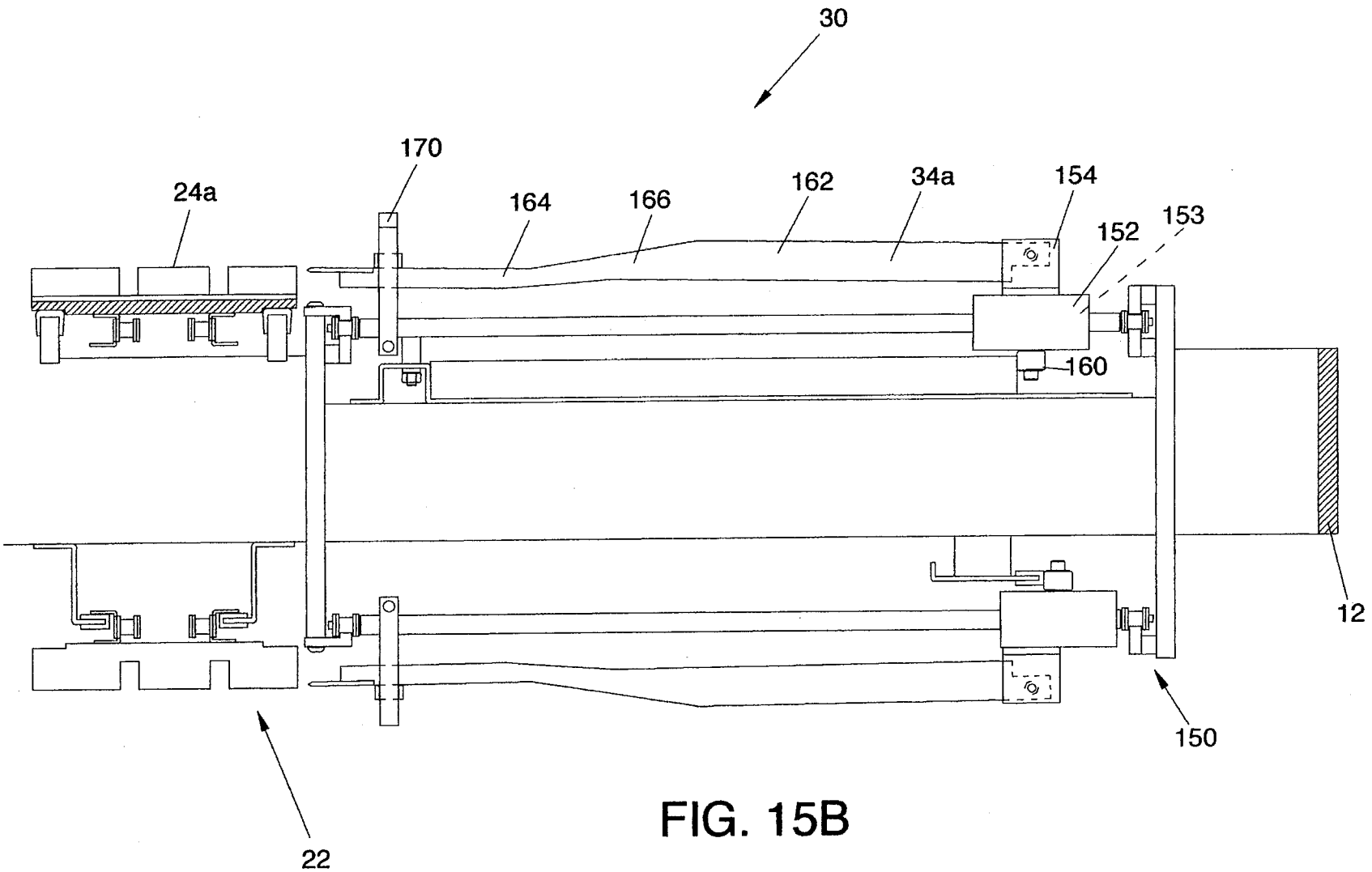

FIGS. 14A–14B illustrates a top view and FIGS. 15A–15B illustrates a side view in partial cross section of the toothbrush 32 positioned from the position illustrated in FIGS. 12A–12B and 13A–13B and inserted fully into the carton 36 during the second stage of carton loading where all numerals correspond to those elements previously described. Prior to being positioned fully into the carton 36, the handle 110 of the toothbrush 32 is held, a toothbrush alignment flap in carton 36 is positioned and the toothbrush tamper arm 174 is activated to return the toothbrush 32 fully to the confines of the carton 36. The carton flaps are then closed by devices known to the art.

LISTING OF COMPONENTS

10 toothbrush packaging device
12 framework
14-14' self-regulating conveyor
16-16' containment slide
18-18' metering mechanism
20-20' starwheel loader assembly
20*a* starwheel
20*b* starwheel
22 toothbrush conveyor
24*a–n* infeed buckets
26 carton conveyor
28 carton placer
29 carton tray
30 brush inserter mechanism
31 brush backup mechanism
32 toothbrushes
34*a–n* conveyored toothbrush loading arms
36 carton
38*a–c* slide plates
38*a'–c' sliding surfaces*
40 mounting bar
42 adjustable bar
44 adjustable bar
45 bracket
46 rod containment guide
46' rod containment guide
48 rod containment guide
48' rod containment guide
50 rod containment guide
50' rod containment guide
52 slot area
53 support bar
54 slotted bar
55 support bar
56 slotted bar
57 support bar
58 plate
58*a–b* recesses
60 pneumatic actuator
62 pneumatic actuator
64 coupling bar
66 drop bar
68 rod linkage assembly
70 rod
72 crank arm
73 pneumatic dampener cylinder
74 crank arm
75 rod
76 adjacent bar
78 frame member
80 frame member
81 plate
82 rod guide
84 rod guide
86 actuating rod
88 actuating rod
90 bar
92*a–n* slot
93*a–n* cutouts
94*a–n* slot
95*a–n* cutouts
96 keeper plate
96*a* semicircular surface
97 slotted bracket
98 keeper plate
98*a* semicircular surface
99 slotted bracket
100 chain
102 guide assembly
104 vertical guide surface
105 bracket
106 body
108 bristle
109 planar surface
110 handle
111 groove/channel
112 extension
112*a* beveled surface
113 upper level sensor transmitter
114 extension
114*a* beveled surface

115 upper level sensor receiver
116 extension
**116*a*** beveled surface
117 lower level sensor transmitter
118 clearance spaces
119 lower level sensor receiver
120 clearance spaces
122 rectangular extension
124 rectangular extension
125 arrow
126 rectangular extension
127 arrow
128 clearance space
130 clearance space
140 conveyored toothbrush load gate
142 conveyored funnel guide
144 conveyored carton flight
146 conveyored toothbrush positioner gate
150 load gate conveyor
152 bearinged slide
153 bearinged slide
154 pivot block
155 supported rod
156 actuating cylinder
157 supported rod
158 channel
160 cam
162 horizontal arm portion
164 horizontal arm portion
166 angled arm portion
168 notched end
170 guide structure
172 funnel guide conveyor
174 tamper arm
175 guide structure
176 toothbrush positioner conveyor
178 bearinged slide
180 bearinged slide
182 support rod
184 support rod
186 actuating cylinder
188 cam
190 cam Various modifications can be made to the present invention without departing from the apparent scope hereof.

We claim:

1. A process placement of toothbrushes in cartons comprising the steps of:

a. loading toothbrushes on one or more self regulating conveyors;

b. conveying said toothbrushes to descend gravitationally down one or more containment slides;

c. metering said toothbrushes in said containment slides by one or more metering mechanisms into one or more star wheel loader assemblies;

d. one or more actuated plates holding one or more toothbrushes in said containment slide in close proximity to one or more sets of starwheels for loading into said starwheels;

e. releasing said toothbrushes held by said actuated plates to the lower region of said containment slide slot area to contact and be held by a drop bar;

f. retracting said drop bar to release said toothbrush into corresponding slot pairs on said starwheels;

g. aligning geometry of said slot pairs and said drop bar for said toothbrush with bristles pointing downwardly upon entry into said starwheels;

h. capturing said toothbrushes in said starwheel slots by keeper plates while said starwheels are rotated;

i. rotating said starwheels to position said slots containing said toothbrushes to a position over and above infeed buckets and from the influence of said keeper plates to allow simultaneous gravitational placement of said toothbrush from said slots into said infeed bucket;

j. releasing said toothbrushes from said starwheel slots to impinge upon beveled surfaces of said infeed buckets to align a handle of said toothbrush along an alignment groove or channel in said infeed bucket;

k. depositing by said starwheel loader assemblies alternatively said toothbrushes into infeed buckets;

l. conveying said toothbrushes on said infeed buckets by a toothbrush conveyor;

m. aligning a carton placer including a carton tray with a carton conveyor located adjacent to one side of said toothbrush conveyor;

n. erecting cartons on said carton placer on carton conveyor;

o. aligning a conveyor brush inserter mechanism having a plurality of loadings arm to one side of said toothbrush conveyor;

p. aligning a conveyored brush backup mechanism having a plurality of tamper arms to one side of said carton conveyor;

q. aligning a conveyored funnel guide between said toothbrush conveyor and said carton conveyor in alignment with said respective load arms, whereby said toothbrush infeed buckets, funnel guides, carton infeed buckets, cartons and toothbrush tamper arms are in alignment;

r. contacting a toothbrush loading arm, having a notched end, for contacting the bristle end of a toothbrush to transport said toothbrush from its position in said infeed bucket, through said funnel guide and into said carton and continuing in motion with the handle of said toothbrush positioned partially beyond the confines of said carton; and, s. positioning a toothbrush alignment flap, said toothbrush tamper arm is positioned to return said toothbrush fully into the confines of said carton where said toothbrush is held in position by said toothbrush alignment flap.

* * * * *